US006176592B1

(12) United States Patent
Kovacik et al.

(10) Patent No.: US 6,176,592 B1
(45) Date of Patent: Jan. 23, 2001

(54) HALOGEN UTILITY LIGHT

(75) Inventors: James D. Kovacik, Brecksville; Paul S. Blanch, Broadview Heights; Stanley E. Grzywna, Elyria, all of OH (US)

(73) Assignee: Alert Safety Lite Products Co., Inc., Bedford Heights, OH (US)

( * ) Notice: Under 35 U.S.C. 154(b), the term of this patent shall be extended for 0 days.

This patent is subject to a terminal disclaimer.

(21) Appl. No.: 09/271,628

(22) Filed: Mar. 17, 1999

(51) Int. Cl.[7] ..... F21L 4/04
(52) U.S. Cl. ..... 362/199; 362/197; 362/287
(58) Field of Search ..... 362/109, 199, 362/294, 287, 285, 376, 264

(56) References Cited

U.S. PATENT DOCUMENTS

| | | | | |
|---|---|---|---|---|
| D. 367,542 | | 2/1996 | Kovacik et al. . | |
| D. 389,931 | | 1/1998 | Kovacik et al. . | |
| 3,560,730 | * | 2/1971 | Morton | 362/198 |
| 4,258,414 | | 3/1981 | Sokol . | |
| 4,262,327 | | 4/1981 | Kovicik et al. | 362/421 |
| 4,287,456 | | 9/1981 | Kovacik et al. | 362/223 |
| 4,321,660 | | 3/1982 | Sokol | 362/283 |
| 4,598,344 | | 7/1986 | Nadler | 362/368 |
| 4,631,644 | * | 12/1986 | Dannhauer | 362/105 |
| 4,774,647 | | 9/1988 | Kovacik et al. | 362/295 |
| 4,977,489 | | 12/1990 | Fung | 362/184 |
| 5,050,055 | * | 9/1991 | Lindsay | 362/293 |
| 5,217,297 | | 6/1993 | Yuen | 362/184 |
| 5,436,815 | | 7/1995 | Grooms et al. | 362/216 |
| 5,465,196 | | 11/1995 | Hasenberg et al. | 362/183 |
| 5,541,822 | * | 7/1996 | Bamber | 362/190 |
| 5,558,425 | | 9/1996 | Pons et al. | 362/490 |
| 5,833,359 | * | 11/1998 | Hollenbach | 362/250 |
| 5,921,658 | * | 7/1999 | Kovacik | 362/199 |

* cited by examiner

*Primary Examiner*—Sandra O'Shea
*Assistant Examiner*—Hargobind S. Sawhney
(74) *Attorney, Agent, or Firm*—MacMillan, Sobanski & Todd, LLC

(57) ABSTRACT

A halogen utility light has a hollow body with a lower handle portion and an upper light portion; a lamp head movably connected to the upper light portion; and a halogen bulb operatively mounted in the lamp head. The lower handle portion is curved along the longitudinal axis of the lower handle portion, and the lower handle portion has a recess containing a switch. The lamp head is pivotally connected to the upper light portion for movement along an arc and incorporates a screen for protecting the halogen bulb. A hook can be provided on a bottom surface of the lower handle portion for removably supporting the halogen utility light in an inverted position. Cooling apertures and slots are provided in the handle and the lamp head.

14 Claims, 3 Drawing Sheets

HALOGEN UTILITY LIGHT

BACKGROUND OF THE INVENTION

The present invention relates generally to a portable lights and, in particular, to a halogen utility light.

Portable lights that can be manually moved and suspended about a work site or the like to aid a user to obtain the best lighting conditions are well known. It has been the practice to use incandescent light bulbs, suitably encased in light guards, for this purpose. Such lights are often referred to as trouble lamps, extension lights, work lights, inspection lights, etc., and are commonly employed by mechanics and other workers who require supplemental light in frequently changing locations. Such a trouble light is shown in the U.S. Pat. No. 4,774,647 to Kovacik et al.

A problem with standard incandescent lights is the size of the bulb and the fragility of the filament. Standard high wattage incandescent bulbs are relatively large and utility lights designed to hold them are proportionally larger. While the amount of light delivered from such lights is significant, large trouble lights are difficult or impossible to maneuver into tight spaces and must be angled to try to have their light penetrate into the desired spot. Unfortunately, such efforts generally create sharp shadows that obscure details. Further, the filament in standard incandescent bulbs is notoriously fragile. Dropping a trouble light with a standard bulb either breaks or fractures the filament making the light inoperable until the bulb is replaced.

SUMMARY OF THE INVENTION

The present invention concerns a halogen utility light comprising: a hollow body having a lower handle portion and an upper light portion. A lamp head is movably connected to the upper light portion; and a halogen bulb is operatively mounted in the lamp head. The lower handle portion of this halogen utility light is preferably curved along the longitudinal axis of the lower handle portion and has a recess containing a push button switch. The lamp head is pivotally connected to the upper light portion and incorporates means for protecting the halogen bulb such as a protective screen or a transparent cover. If a transparent cover is used, the cover may additionally incorporate at least one lenticular region for focusing or diffusing light from the halogen bulb. Means for attaching the lamp may be incorporated in the lower handle portion or the lamp head such as a magnet or a hook for removably attaching the halogen utility light in any desired spot. The light may be configured to use AC or DC halogen bulbs.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
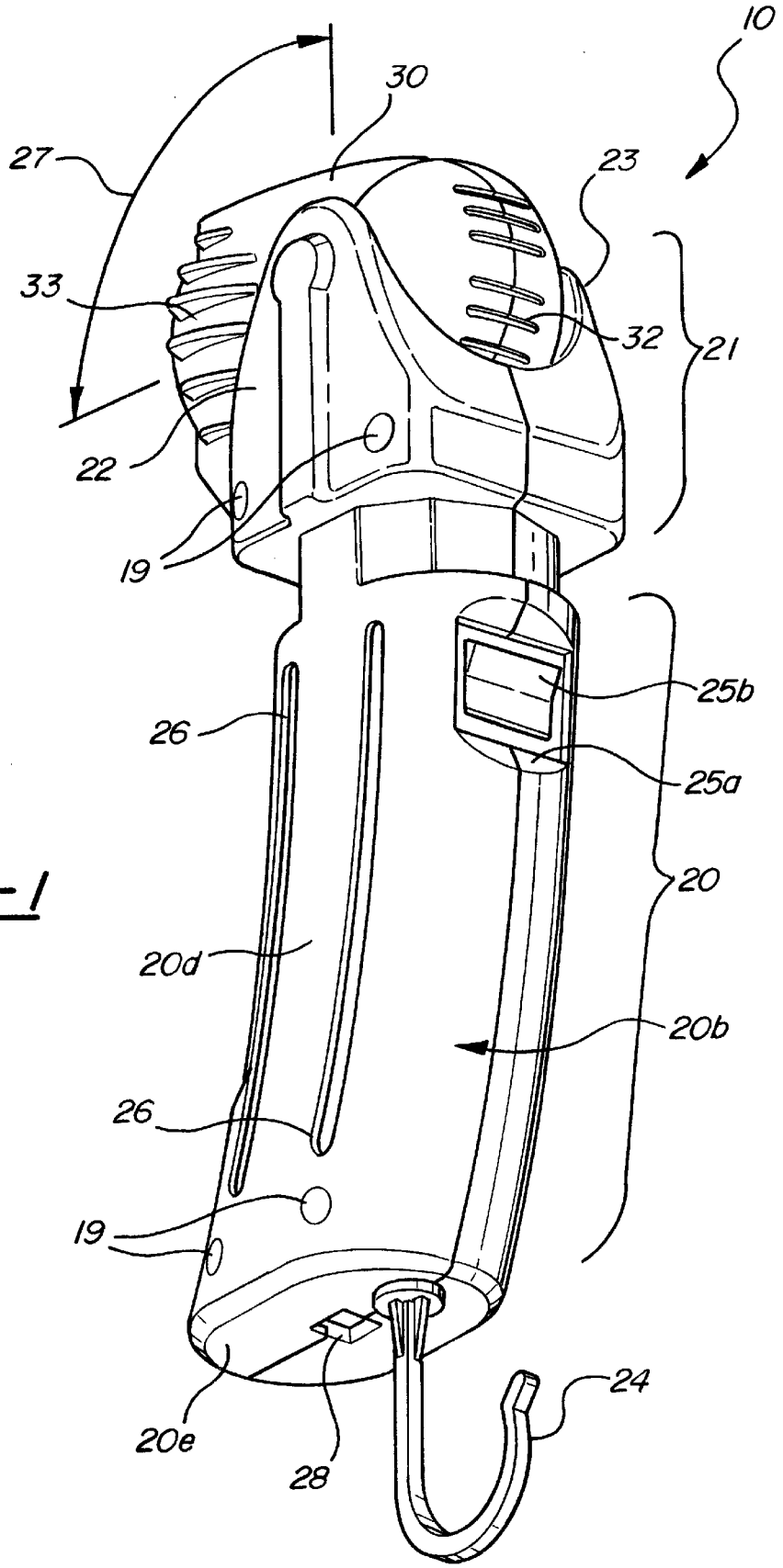
FIG. 1 is a rear perspective view of a halogen utility light in accordance with the present invention.
Figure 2:
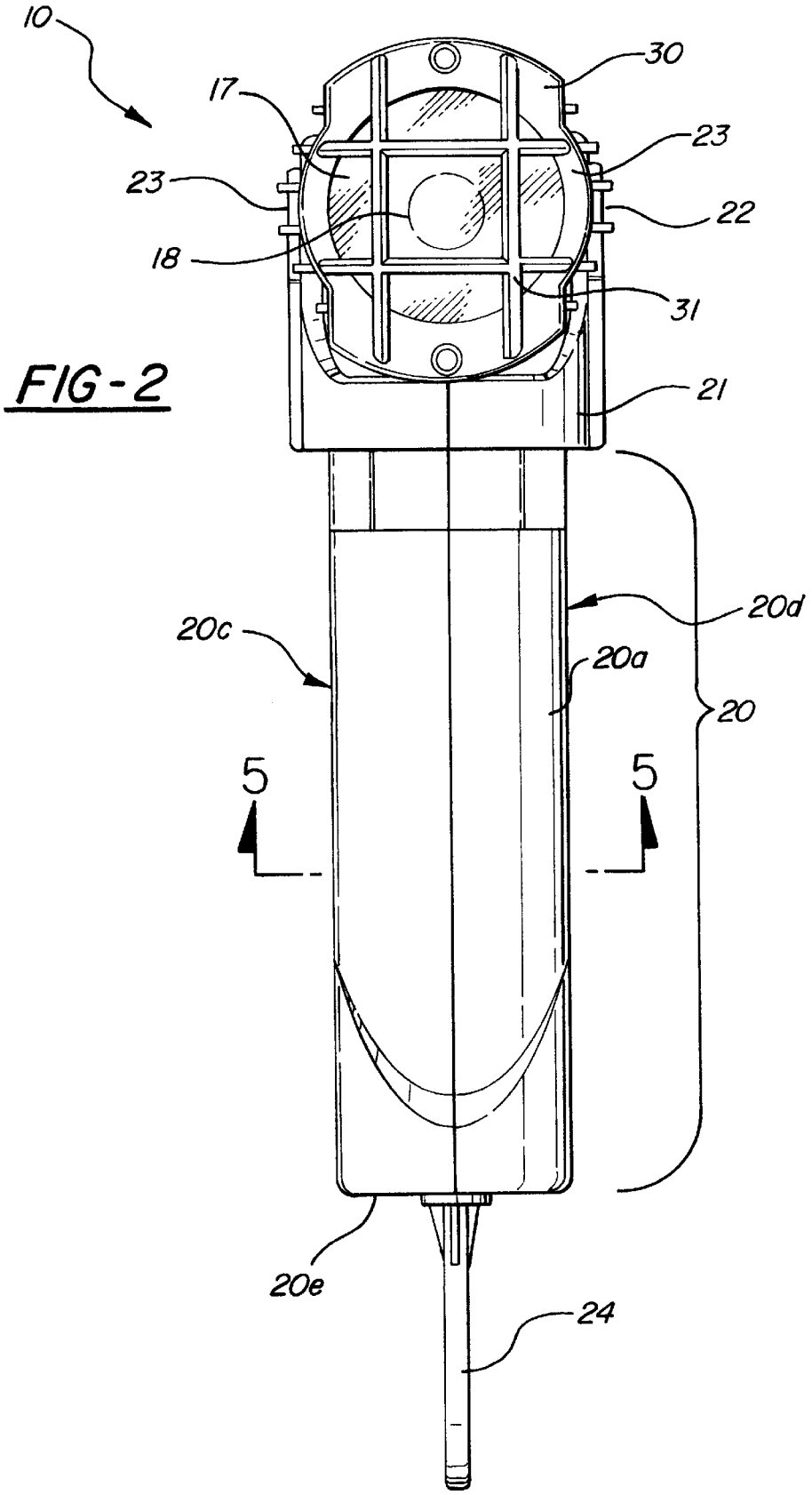
FIG. 2 is a front elevation view of the utility light shown in the FIG. 1.
Figure 3:
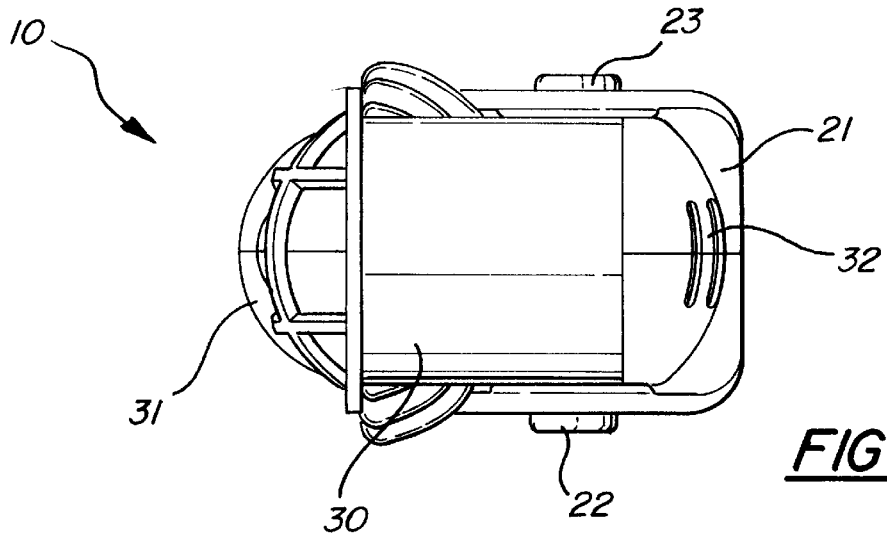
FIG. 3 is a top plan view of the utility light shown in the FIG. 1.

There is shown in FIGS. 1–5 a halogen utility light 10 in accordance with the present invention. FIG. 1 is a perspective view of the halogen utility light 10 showing a rear surface 20*b*, a right side surface 20*d*, and a bottom surface 20*e*. FIG. 2 shows a front surface 20*a* and a left side surface 20*c* is a mirror image of the right side surface 20*d*. The utility light 10 has a vertically elongated handle formed as a hollow body including a lower handle portion 20 and an upper light portion 21. A lamp head 30 is moveably attached to an upper end of the upper light portion 21. A halogen bulb 18 is operatively fixed in the lamp head 30 as described below.

The hollow body 20 and 21 and the lamp head 30 may be formed from a suitable material such as plastic or metal, preferably plastic. It is most preferred that the hollow body and lamp head be formed from a durable plastic material, such as polycarbonate, polyethylene, or polypropylene. The hollow body and lamp head may be formed using any suitable process such as injection molding, vacuum molding, or blow molding. Preferably, the hollow body and/or the lamp head are formed from a pair of complementary longitudinally extending half shells. These half shells may be joined together using a plurality of threaded fasteners 19 extending through apertures formed in one shell to threadably engage apertures formed in studs or posts (not shown) extending inside the opposite shell. Alternatively, the half shells may be joined together using adhesive, ultrasonic welding, rivets, brads, etc.

As shown in FIGS. 1–5, the lower handle portion 20 is generally rectangular in cross section with the front surface 20*a*, the rear surface 20*b*, the left side surface 20*c*, the right side surface 20*d* and the bottom surface 20*e* joined by rounded corners. The front surface 20*a* and the rear surface 20*b* are curved both about the longitudinal axis and along the longitudinal axis. The surfaces 20*a* and 20*b* extend generally parallel to one another along the longitudinal axis to provide a convenient grip for a human hand. The side surfaces 20*c* and 20*d* have generally longitudinally extending apertures 26 formed through the walls thereof. In addition to the promoting air flow through the handle as discussed below, these apertures 26 (or alternatively projections formed at the same points) create an irregular surface that aids in preventing the utility light 10 from slipping from the grasp of a human hand.

The rear surface 20*b* has a recess or depression 25*a* formed therein near the upper end thereof. A switch, such as a push button switch 25*b*, is mounted in an aperture formed in the wall of the recess 25*a* for actuation by the thumb of a human hand. The recessed switch 25*b* is protected from accidental actuation by being positioned below the plane of the rear surface 20*b*. Alternatively, the switch 25*b* can be mounted in any desired position, such as on the front surface 20*a* of the lower handle portion 20 where it could be conveniently operated with the user's index finger, on the lamp head 30, or on any of the surfaces 20*c*, 20*d* and 20*e*.

The lamp head 30 is moveably positioned in the upper light portion 21. The upper light portion 21 includes a pair of upwardly extending generally parallel arms 22 and 23 by which the light head 30 is pivotally held for movement in an arc 27 of approximately 90° from the first end position shown with a light emitting front portion of the head pointing generally transverse to the longitudinal axis of the hollow body portions 20 and 21 to a second end position pointing generally along the longitudinal axis. The moveable lamp head 30 permits light from the utility light 10 to be directed more precisely, particularly when using the light in tight areas wherein the handle of a fixed light cannot be moved to direct to light in the desired direction. For example, the head 30 can be provided with an opposed pair of outwardly extending posts or axles (not shown) each cooperating with an associated bearing recess (not shown) on one of the arms 22 and 23. Rotation can be limited, for example, by providing an opposed pair of arcuate slots (not shown) in the head 30 and a cooperating pair of inwardly extending stops or posts on the arms 22 and 23. If desired, detents (not shown) can be provided to maintain the head 30 in any intermediate position between the ends of the arc 27.

A hook 24 may be incorporated into the lower handle portion (attached to the bottom surface 20*e* as illustrated), on the upper light portion 21 (not shown), or on the lamp head 30 (not shown) for removably fixing the utility light 10 of the invention on a convenient projection. Alternatively, a magnetic means may be substituted for the hook 24 to permit the utility light 10 to be removably fixed on any metallic surface. Once the utility light 10 is removably fixed at some location using a hook, magnet, vacuum vise, etc. the pivoting lamp head 30 permits light to be directed along the arc 27 as desired. As shown, the hook 24 will support the utility light 10 in an inverted position. Also provided on the bottom surface 20*e* is a cord aperture 28 through which a power cord (not shown) passes to provide electrical power for the bulb 18.

The present invention is configured specifically to incorporate a halogen bulb. Halogen bulbs have a number of advantages over conventional incandescent bulbs. Halogen bulbs are significantly smaller in size than standard incandescent bulbs having the same wattage or lumen rating. More importantly, halogen bulbs have a more durable filament than standard incandescent bulbs making them much less susceptible to damage from hard impacts. In addition, some halogen bulbs are manufactured with an attached reflector thereby assuring perfect alignment of the bulb and reflector for maximum light (flood or spot). The lamp head 30 of the halogen utility light 10 of the present invention can include a typical reflector 17 and a mounting socket for the halogen bulb 18. The bulb 18, the socket and the reflector 17 are commercially available items manufactured by a number of companies including Philips.

The utility light 10 according to the invention may be configured to run off AC or DC current. For example, the utility light 10 may be designed to run off AC line current or DC current from a battery pack or from the electrical system of an automobile, truck, or boat, etc. If a DC current source is used, it typically would be at 12 volts and the halogen bulb 18 would be a 12 volt DC bulb and the bulb and the switch 25*b* would be wired in series with the power cord. If an AC current source is used, the bulb 18 could be AC or DC but typically would be designed for a lower voltage than the 110 volt power provided by utilities to commercial and residential customers. The input voltage must be reduced utilizing a transformer 40 (FIG. 5) that can be mounted inside the hollow body lower handle portion 20. The transformer 40 would also convert the AC power supply current to DC current if the bulb 18 is a DC bulb. Alternately, the transformer 40 can be replaced with a battery power supply. Support for such the transformer 40 or other components can be provided in the inner surface of the hollow body 20 by forming half shells with a plurality of stops or posts 41 for engaging and holding the component in position.

The lamp head 30 of the present invention incorporates means for protecting the halogen bulb 18. Preferably, this means for protecting is a protective screen or cage 31 positioned at an open front side of the head 30 in front of the bulb 18 and the reflector 17. The function of such a protective screen 31 is twofold: to protect the bulb 18 and the reflector 17 from damage and to keep the user from accidentally contacting the bulb/reflector assembly, which can get hot during use. The screen 31 is removably attached to the lamp head 30 by suitable means such as fasteners that permit the removal of the screen for changing the bulb 18.

Alternatively, or in addition to a protective screen 31, the protective means may be a protective cover over the bulb 18 and the reflector 17. Such a cover may be transparent, frosted, or tinted as desired. Additionally, the cover may incorporate one or more lenticular regions for focusing or diffusing light from the halogen bulb 18.

If desired, the utility lamp 10 according to the invention may be configured with the side portions 33 of the lamp head 30 surrounding the bulb 18 and the reflector 17 formed from a transparent or translucent material to maximize the emission of light and increase the size of the lighted area.

In order to dissipate heat generated by the transformer 40, or other components mounted inside the hollow body lower handle portion 20, the apertures 26 are provided. Similarly, in order to dissipate heat generated by the halogen bulb 18, a plurality of generally horizontally extending apertures 32 may be formed through a rear wall of the lamp head 30.

The open ends of the apertures 26 and the slots 32 at the outer surface of the respective walls can be offset relative to the open inner ends to provide an angled or circuitous path as a safety feature. This makes it difficult to inadvertently insert a metal object through the apertures 26 and the slots 32 into contact with wiring and/or electrical components 40 thereby reducing the danger of electrical shock..

Figure 4:
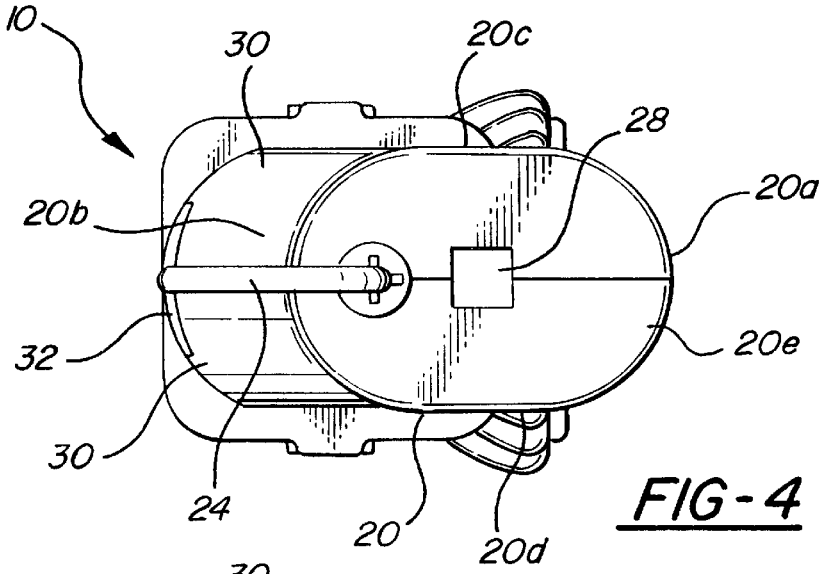
FIG. 4 is a bottom plan view of the utility light shown in the FIG. 1.
Figure 5:
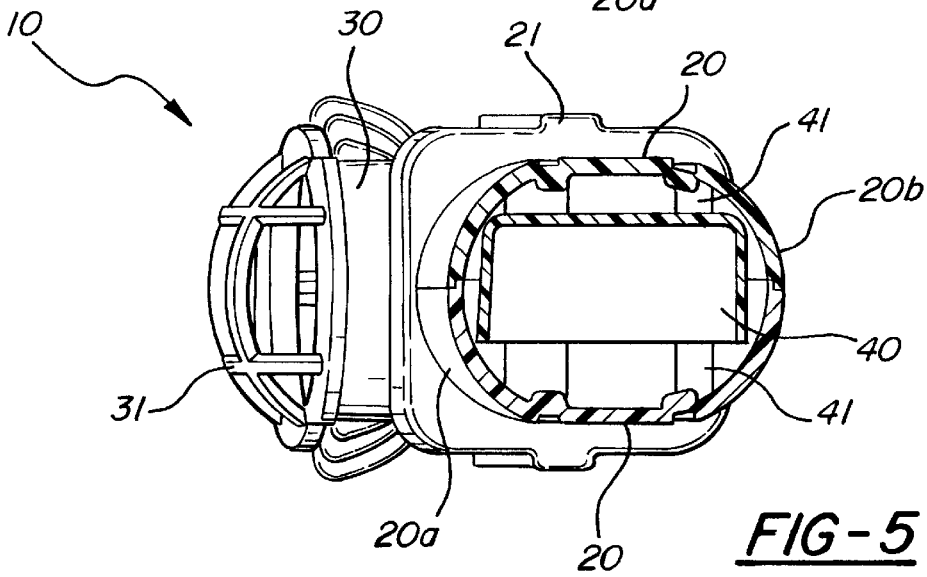
FIG. 5 is a cross sectional view of the utility light taken along the line 5—5 in the FIG. 2.

As best shown in the FIGS. 1 and 4, there is an area of the bottom surface 20*e* adjacent the cord aperture 26 in which a female electrical receptacle (not shown) can be provided to facilitate the use of electrically powered devices such as power tools. The receptacle or socket is typically connected through the push button switch 25*b* to the power cord so that electrical power is available at the receptacle only when the light is turned on. By positioning the optional electrical socket on the bottom surface 20*e*, the power cord for the utility light 10 and any electrical cord plugged into the socket extend generally parallel to one another making it easier to move and use the utility light with an electrical appliance plugged into the outlet. This is a superior configuration to prior art utility lights that locate an extra outlet such that the male plug engages such extra outlet at a right angle to the longitudinal axis of the utility light.

In summary, the halogen utility light 10 according to the present invention, as illustrated in the accompanying drawings includes: a closed hollow body having the upper light portion 21 and the lower handle portion 20, wherein the upper light portion is configured to form the pair of pivot arms 22 and 23 that hold the lamp head 30 therebetween for pivotal movement along the arc 27. The lamp head 30 has the protective screen assembly 31 positioned over the bulb 18 and the reflector 17 assembly. The hook 24 is positioned at the bottom 20*e* of the utility light 10 to permit the light to be removably attached to any convenient projection. The lower handle portion 20 further is curved and has the recess 25*a* formed in the upper end of the rear surface 20*b* to retain the switch 25*b*. The apertures 26 are formed in the lower handle portion side surfaces 20*c* and 20*d* and the slots 32 are formed in the lamp head 30 to promote air flow through the handle 20 and the lamp head to provide cooling.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A halogen utility light comprising:

a hollow body having a lower handle portion and an upper light portion extending along a longitudinal axis, said lower handle portion being curved along a longitudinal axis ad said upper light portion having a pair of upstanding spaced apart arms;

a lamp head having a light emitting front portion and being pivotally mounted in said upper light portion arms for movement of said light emitting front portion along a predetermined arc between a first end position pointing generally transverse to the longitudinal axis of said hollow body portions to a second end position pointing generally along the longitudinal axis;

a halogen light bulb mounted in said lamp head whereby when said halogen light bulb is connected to a source of electrical power light is emitted from said light emitting front portion; and wherein said halogen light bulb is operated by a DC current, the source of electrical power is an AC current source and including a transformer for generating DC current to said halogen light bulb from the AC current source.

2. The halogen utility light according to claim 1 wherein said hollow body and said lamp head are each formed from a separate pair of complementary half shells joined together.

3. The halogen utility light according to claim 1 wherein said lower handle portion has a recess formed therein and including a push button switch mounted in said recess for connection between said halogen lamp and a source of electrical power.

4. The halogen utility light according to claim 1 wherein said lamp head has a reflector mounted therein for focusing light from said halogen light bulb through said light emitting front portion of said lamp head.

5. The halogen utility light according to claim 1 wherein said lamp head includes a means for protecting said halogen bulb.

6. The halogen utility light according to claim 5 wherein said means for protecting is a protective screen removably attached to said lamp head and extending across said light emitting front portion.

7. The halogen utility light according to claim 1 including a hook attached to a bottom surface of said lower handle portion for supporting the halogen utility light in an inverted position.

8. The halogen utility light according to claim 1 wherein said transformer is mounted inside said lower handle portion.

9. The halogen utility light according to claim 1 wherein said lower handle portion has a plurality of cooling apertures formed therein extending between inside and outside surfaces of side walls of said lower handle portion.

10. The halogen utility light according to claim 9 wherein opposite open ends of each of said cooling apertures are offset from one another.

11. The halogen utility light according to claim 1 wherein said lamp head has a plurality of slots formed therein extending through a rear wall thereof.

12. The halogen utility light according to claim 11 wherein opposite open ends of each of said slots are offset from one another.

13. A halogen utility light comprising:

a hollow body having a lower handle portion and an upper light portion extending along a longitudinal axis, said hollow body being curved along the longitudinal axis, said upper light portion having a pair of upstanding spaced apart arms, said lower handle portion having a recess formed therein;

a lamp head having a light emitting front portion and being pivotally mounted in said upper light portion arms for movement of said light emitting front portion along a predetermined arc between a first end position pointing generally transverse to the longitudinal axis of said hollow body portions to a second end position pointing generally along the longitudinal axis;

a push button switch mounted in said recess; and a halogen light bulb mounted in said lamp head whereby when said halogen light bulb is connected to a source of electrical power through said push button switch and said push button switch is turned on, light is emitted from said light emitting front portion.

14. A halogen utility light comprising:

a hollow body having a lower handle portion and an upper light portion extending along a longitudinal axis and being formed from complementary half shells joined together, said hollow body being curved along the longitudinal axis, said upper light portion having a pair of upstanding spaced apart arms, said lower handle portion having a recess formed therein;

a lamp head having a light emitting front portion and being pivotally mounted in said upper light portion arms for movement of said light emitting front portion along a predetermined arc between a first end position pointing generally transverse to the longitudinal axis of said hollow body portions to a second end position pointing generally along the longitudinal axis, said lamp head being formed from complementary half shells joined together;

a reflector mounted in said lamp head and having a reflective surface facing said light emitting front portion;

a halogen light bulb mounted in said lamp head in front of said reflector whereby when said halogen light bulb is connected to a source of electrical power through said push button switch and said push button switch is turned on, light is emitted from said light emitting front portion; and a protective screen removably attached to said lamp head and extending across said light emitting front portion.

* * * * *

UNITED STATES PATENT AND TRADEMARK OFFICE

CERTIFICATE OF CORRECTION

PATENT NO. : 6,176,592 B1
DATED : January 23, 2001
INVENTOR(S) : James D. Kovacik et al.

It is certified that error appears in the above-identified patent and that said Letters Patent is hereby corrected as shown below:

Title page,
Insert Item -- [63], Related U.S. Application Data, Continuation-in-Part of Application No. 08/823,952 filed March 25, 1997, now U.S. Patent No. 5,921,658 --

Signed and Sealed this

Ninth Day of August, 2005

JON W. DUDAS
*Director of the United States Patent and Trademark Office*